US008479353B2

(12) United States Patent
Drivstuen et al.

(10) Patent No.: US 8,479,353 B2
(45) Date of Patent: Jul. 9, 2013

(54) HOSE VALVE APPARATUS AND METHOD FOR RETRACTABLE HOSE VACCUM SYSTEMS

(76) Inventors: Rod Drivstuen, Monroe, WA (US); Robert Lee Rawls, Woodinville, WA (US)

( * ) Notice: Subject to any disclaimer, the term of this patent is extended or adjusted under 35 U.S.C. 154(b) by 944 days.

(21) Appl. No.: 12/460,833

(22) Filed: Jul. 23, 2009

(65) Prior Publication Data

US 2010/0024152 A1 Feb. 4, 2010

Related U.S. Application Data

(60) Provisional application No. 61/135,853, filed on Jul. 23, 2008.

(51) Int. Cl.
*A47L 5/38* (2006.01)

(52) U.S. Cl.
USPC ..... 15/301; 15/315

(58) Field of Classification Search
USPC ..... 15/314, 315, 318, 339, 301; 285/302, 285/303
See application file for complete search history.

(56) References Cited

U.S. PATENT DOCUMENTS

| | | | |
|---|---|---|---|
| 3,023,447 | A | 3/1962 | Senne |
| 3,213,480 | A | 10/1965 | Miller |
| 3,568,240 | A | 3/1971 | Hamrick |
| 3,682,500 | A | 8/1972 | Hamrick |
| 3,942,963 | A | 3/1976 | Tevis |
| 3,958,297 | A | 5/1976 | Hukuba et al. |
| 3,977,038 | A | 8/1976 | Hukuba et al. |
| 4,211,457 | A | 7/1980 | Meadows |
| 4,316,304 | A | 2/1982 | Parise et al. |
| 4,462,649 | A | 7/1984 | Medford et al. |
| 4,634,197 | A | 1/1987 | Horlacher, Jr. |
| 4,664,457 | A | 5/1987 | Suchy |
| 4,688,292 | A | 8/1987 | Schmiegel |
| 4,688,596 | A | 8/1987 | Liebmann et al. |
| 4,846,712 | A | 7/1989 | Holden et al. |
| 4,894,020 | A | 1/1990 | Holden et al. |
| 4,895,528 | A | 1/1990 | Choiniere et al. |
| 5,069,635 | A | 12/1991 | Holden et al. |
| 5,430,978 | A | 7/1995 | Kohler |
| 5,526,842 | A | 6/1996 | Christensen |

(Continued)

FOREIGN PATENT DOCUMENTS

| | | |
|---|---|---|
| CA | 880976 | 9/1971 |
| CA | 881627 | 9/1972 |

(Continued)

*Primary Examiner* — Robert Scruggs
(74) *Attorney, Agent, or Firm* — William Forster

(57) ABSTRACT

A hose valve for central vacuum cleaning systems that employ retractable suction hoses of the type that retract into a system vacuum pipe. The hose valve comprises a valve box with a connection port wherein a locking assembly is secured within the valve box. The locking assembly includes a compression cylinder. A cylindrical deformable sleeve is coaxially disposed within the compression cylinder. The deformable sleeve is radially inwardly deformable responsive to an axial compressive force. A thrust means is provided for engagement with the compression cylinder to impose a compressing force on the deformable sleeve. The thrust means being axially movable from a first unlocked non-compressing position where the deformable sleeve is in its non-deformed condition, to a second locked compressed position where the deformable sleeve is compressed to cause deformation with its walls collapsing radially inward to form a seal around a retractable hose disposed through the locking assembly.

20 Claims, 10 Drawing Sheets

U.S. PATENT DOCUMENTS

| | | | |
|---|---|---|---|
| 5,578,795 | A | 11/1996 | Ward |
| 5,740,581 | A | 4/1998 | Harrelson, II |
| 5,740,582 | A | 4/1998 | Harrelson, II |
| 6,143,996 | A | 11/2000 | Skanda |
| 6,158,080 | A | 12/2000 | Schlapkohl |
| 7,010,829 | B2 | 3/2006 | Harman et al. |
| 7,226,302 | B2 | 6/2007 | Walter et al. |
| 2001/0022009 | A1 | 9/2001 | Spearman |
| 2002/0069477 | A1 | 6/2002 | Smith et al. |
| 2005/0183228 | A1 | 8/2005 | Snyder |
| 2007/0174991 | A1 * | 8/2007 | Trotter ..... 15/314 |

FOREIGN PATENT DOCUMENTS

| | | |
|---|---|---|
| CA | 908915 | 9/1972 |
| EP | 0399991 A1 | 5/1990 |
| WO | WO 0124677 A1 | 4/2001 |

* cited by examiner

HOSE VALVE APPARATUS AND METHOD FOR RETRACTABLE HOSE VACCUM SYSTEMS

This application claims the benefit of U.S. Provisional Application No. 61/135,853 filed Jul. 23, 2008

BACKGROUND

This invention relates generally to central vacuum cleaning systems, and more particularly to central vacuum cleaning systems comprising retractable suction hoses that retract through a hose valve, into a system vacuum pipe.

Central vacuum cleaning systems are well known and have been available for many years. One early design is U.S. Pat. No. 3,593,363 issued in 1972 disclosing a central vacuum cleaning system using a retractable hose. The inserted end of the hose has a compressible annular seal. The hose is pulled out of the suction conduit located in a wall or floor until the foot end or inserted end reaches the receptacle mounted on the floor or wall, at which time the annular seal on the hose engages a corresponding annular abutment at the receptacle to hold the hose in position and seal between the hose and the receptacle. Accordingly, this design requires that the full length of the hose be pulled out prior to the user using the vacuum.

In 1987, U.S. Pat. No. 4,688,596 issued disclosing a wall outlet box for a control vacuum system that connects to a vacuum hose. The '596-design does not provide any hose storage, or retractable hose features.

In 1990, U.S. Pat. No. 4,895,528 issued disclosing a hose-to-wall fitting for a central vacuum system. Like the earlier '596 reference, the features of the '528 patent were directed to a hose connection fitting only.

Later, in 1996, U.S. Pat. No. 5,526,842 issued to Christensen disclosing a motorized hose wind-up mechanism that requires a somewhat complicated and expensive mechanism for the operation thereof.

While most of the above noted central vacuum system designs include features that are useful in the task to perform the debris vacuum removal process, they typically do not provide a simple, quick way of deploying a long vacuum hose to a selected length. In addition, these designs do not address the problems associated with convenient storage of such long hoses.

Accordingly, a need remains for a hose valve, for a central vacuum cleaning system, that is easy to install, and facilitates ease of deployment of the vacuum hose therein, and ease of storage of the same following the use of a long vacuum hose to quickly clean large areas.

SUMMARY OF THE INVENTION

One object of the present invention is to reduce the effort required to deploy and operate a central vacuum system.

A second object is to reduce the costs associated with installing a central vacuum system.

Another object is to manage and easily store a long vacuum hose in a central vacuum system.

Yet another object is to employ common readily available vacuum accessories constructed for use with central vacuum systems.

A further object is to stabilize and maintain a deployed vacuum hose that moves responsive to the vacuum created by a central vacuum system.

Still another object is to maintain the air seal around a vacuum hose designed to retract in a vacuum system pipe.

An additional object is to allow the user to select the desired length of vacuum hose needed to perform the vacuum process.

The invention is a hose valve for central vacuum cleaning systems that employ retractable suction hoses of the type that retract into a system vacuum pipe. The hose valve comprises a valve box formed to define an interior volume, and a connection port that is in communication with the interior volume. A locking assembly is secured to the valve box. The locking assembly defines a passage for receiving and guiding a retractable hose that extends through the interior volume, and through the locking assembly and connection port.

More specifically, the locking assembly comprises a compression cylinder having a radially inner cylinder surface disposed about a longitudinal axis. The compression cylinder also includes a sleeve seat disposed around the radially inner cylinder surface. The locking assembly also comprises a cylindrical deformable sleeve coaxially disposed within the compression cylinder. The deformable sleeve has a compression end arranged to engage the sleeve seat, and a flange end formed to be secured to the connection port of the valve box. The deformable sleeve is radially inwardly deformable responsive to an axial compressive force, e.g., the deformable sleeve is collapsible inwardly.

Finally, a thrust means is provided for engagement with the compression cylinder to impose a compressing force on the deformable sleeve. The thrust means being axially movable from a first unlocked non-compressing position where the deformable sleeve is in its non-deformed condition, to a second locked compressed position where the deformable sleeve is compressed to cause deformation with its walls collapsing radially inward to form a seal around a retractable hose disposed through the locking assembly.

In addition to forming a seal, the deformable sleeve applies pressure to the retractable hose to firmly hold it in place so that the vacuum created within the hose does not cause the same to retract back into the system vacuum pipe.

As will be discussed more fully below, one embodiment of a thrust means includes a cylindrical thrust ring rotatable about a longitudinal axis, and a compression cylinder coaxially disposed within the thrust ring.

With this arrangement, the thrust ring defines a radially inner ring surface, and two opposing end surfaces. The thrust ring is secured against longitudinal movement within the valve box to restrict movement along the longitudinal axis. Further, a helical track is disposed on the radially inner ring surface, wherein the helical track is spiraling longitudinally. As noted above, compression cylinder is coaxially disposed within the thrust ring, the compression cylinder having a radially inner cylinder surface, a sleeve seat disposed around the radially inner cylinder surface, and a radially outer cylinder surface.

Formed on the radially outer cylinder surface of the compression cylinder is a track follower disposed for engagement with the helical track. Disposed within the compression cylinder is a cylindrical deformable sleeve. The deformable sleeve includes a compression end arranged to engage the sleeve seat, and a flange end secured to the connection port of the valve box.

With this arrangement, the thrust ring is rotatable about a longitudinal axis, wherein the track follower engages the helical track to move the compression cylinder in the direction of the longitudinal axis to compress the deformable sleeve. Accordingly, the thrust ring shifts from a first unlocked, non-compressing position where the deformable sleeve is in the non-deformed condition, to a second locked, compressing position where the compression cylinder shifts coaxially to compress the deformable sleeve, collapsing the sleeve inward to conform around the vacuum hose creating an air tight seal around the vacuum hose.

The foregoing and other objects, features, and advantages of this invention will become more readily apparent from the following detailed description of a preferred embodiment which proceeds with reference to the accompanying drawings, wherein the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention.

DETAILED DESCRIPTION OF PREFERRED EMBODIMENT

Figure 8:
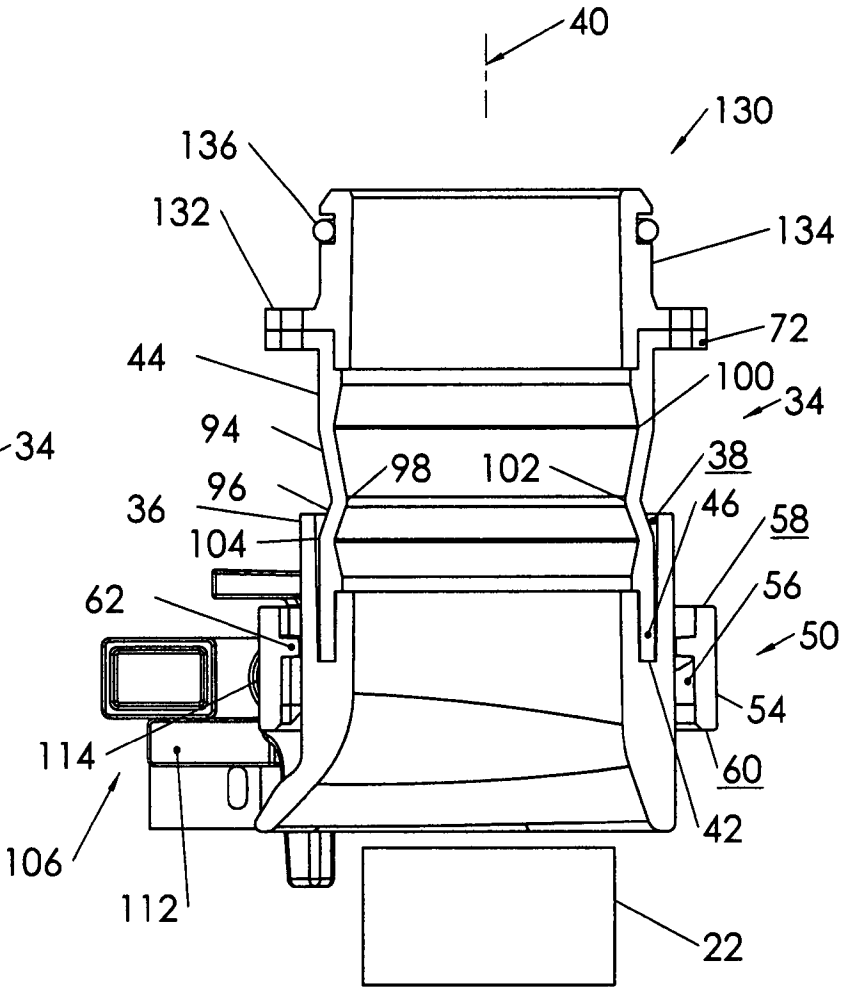
FIG. 8 is a cross-sectional view of a locking assembly with a vacuum pipe connector, and a switch assembly retaining the thrust ring.
Figure 7:
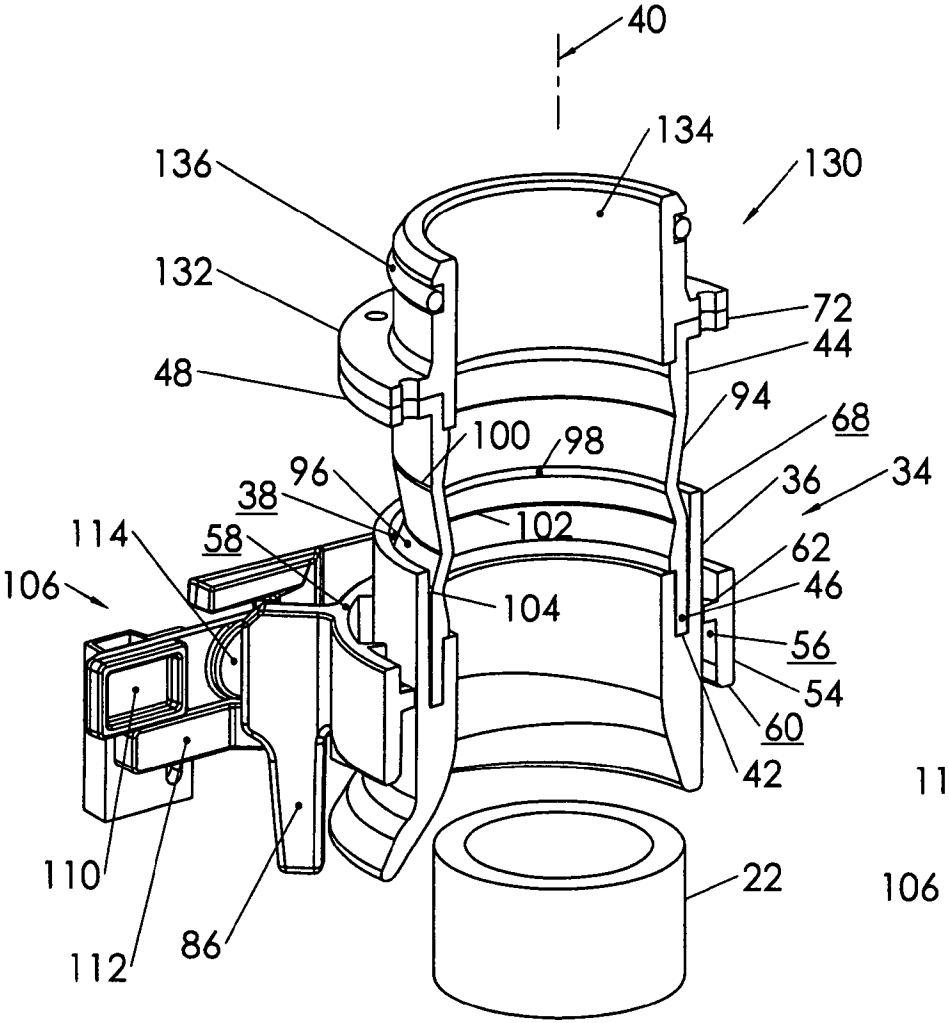
FIG. 7 is a perspective sectional view of a locking assembly with a vacuum pipe connector, wherein the thrust ring in the first unlocked, non-compressing position, and a switch assembly is retaining the thrust ring within the thrust ring slot.
Figure 10:
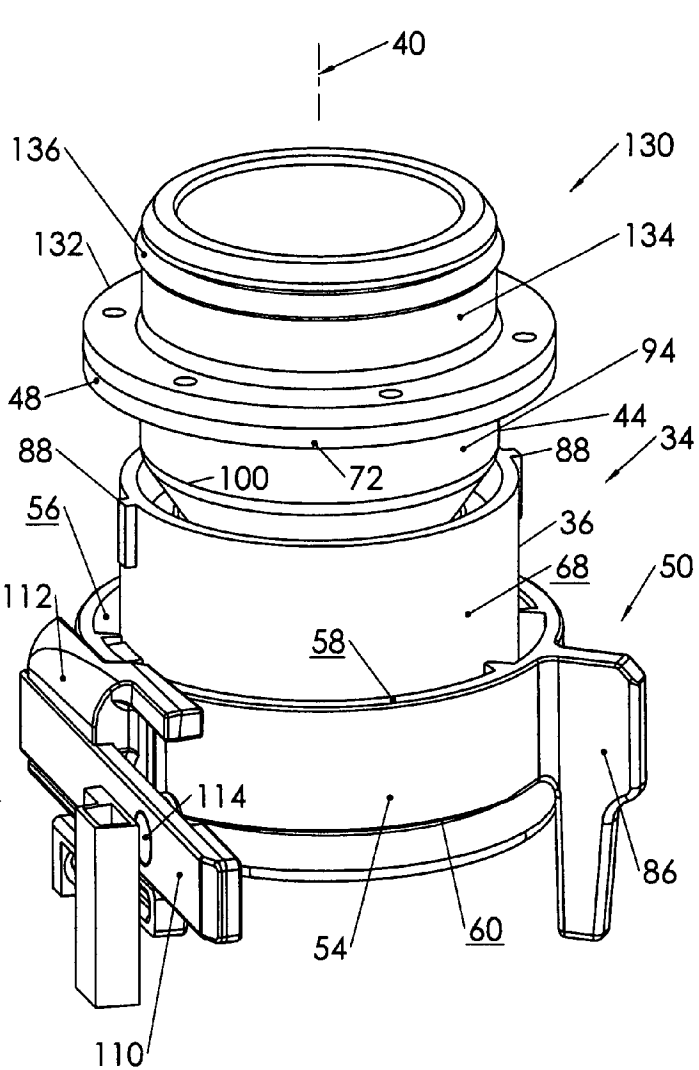
FIG. 10 is a perspective view of a locking assembly with a vacuum pipe connector, wherein the thrust ring in the second locked compressing position to cause the deformable sleeve to collapse and fold inward.
Figure 9:
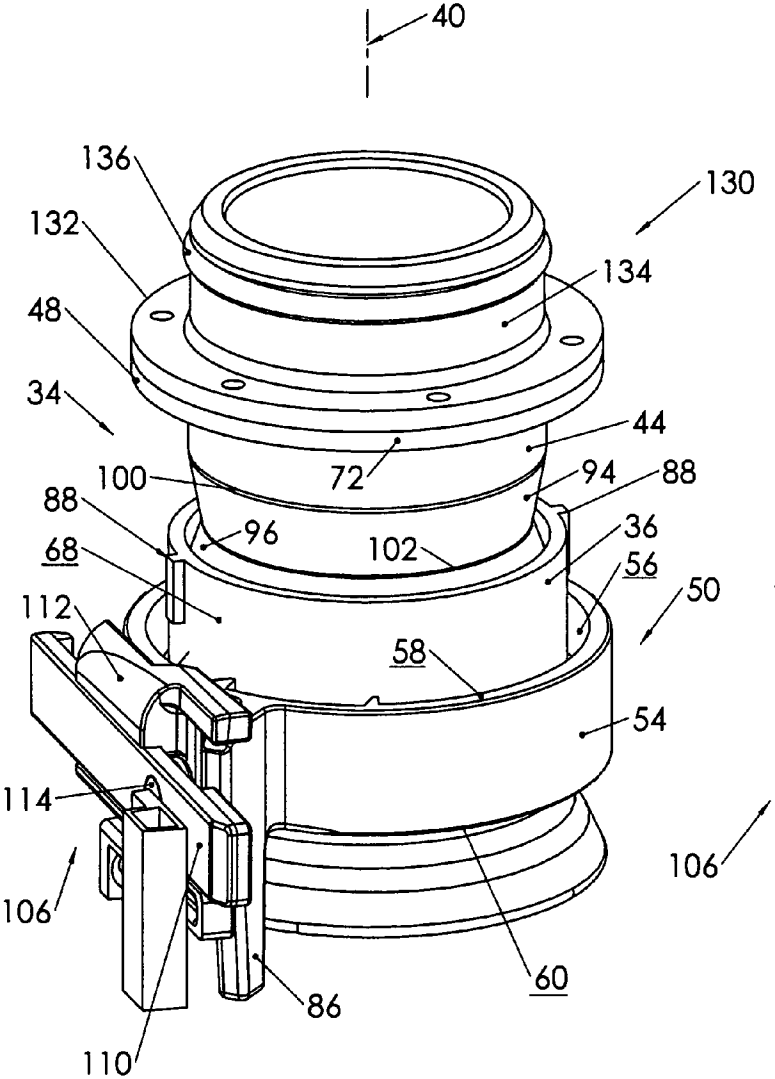
FIG. 9 is a perspective view of a locking assembly with a vacuum pipe connector, wherein the thrust ring in the first unlocked, non-compressing position, and a switch assembly is retaining the thrust ring within the thrust ring slot.
Figure 11:
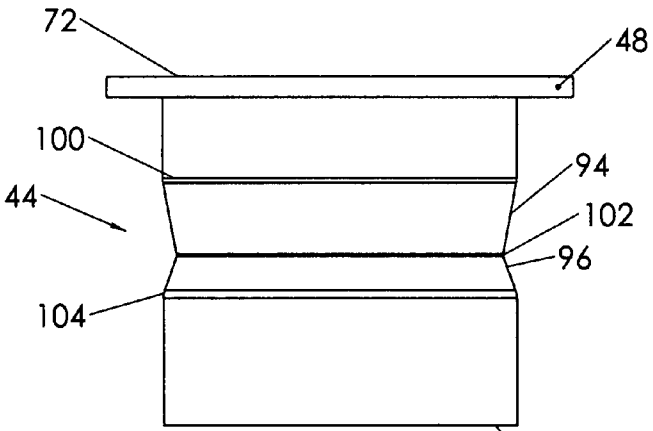
FIG. 11 is an elevation view of a deformable sleeve is its non-deformed condition.
Figure 12:
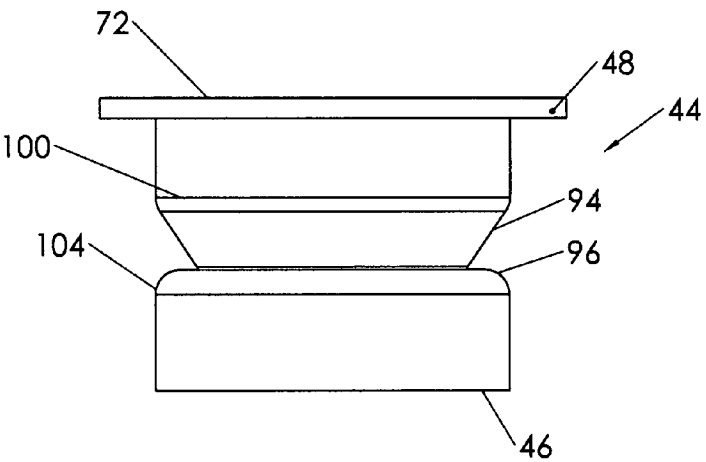
FIG. 12 is an elevation view of a deformable sleeve in its deformed compressed condition with its wall collapsed and folded inward.
Figure 13:
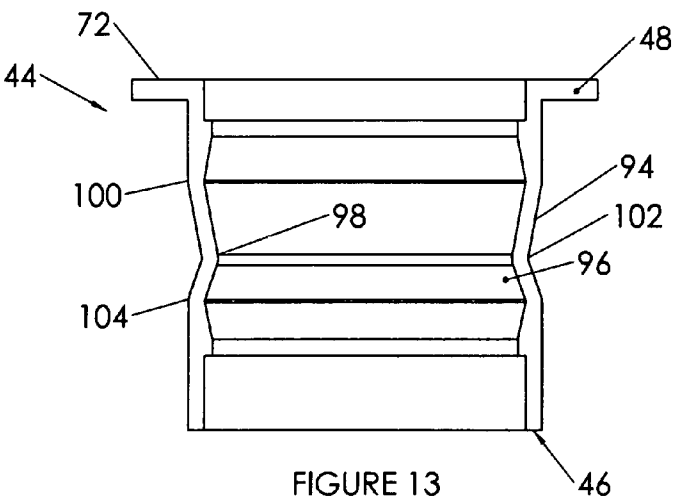
FIG. 13 is a cross-section of a deformable sleeve in its non-deformed condition.
Figure 14:
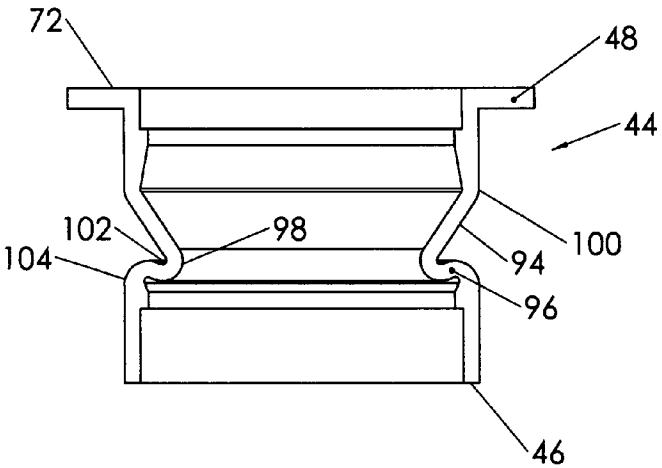
FIG. 14 is a cross-section of a deformable sleeve in its deformed compressed condition with its wall collapsed and folded inward.
Figure 16:
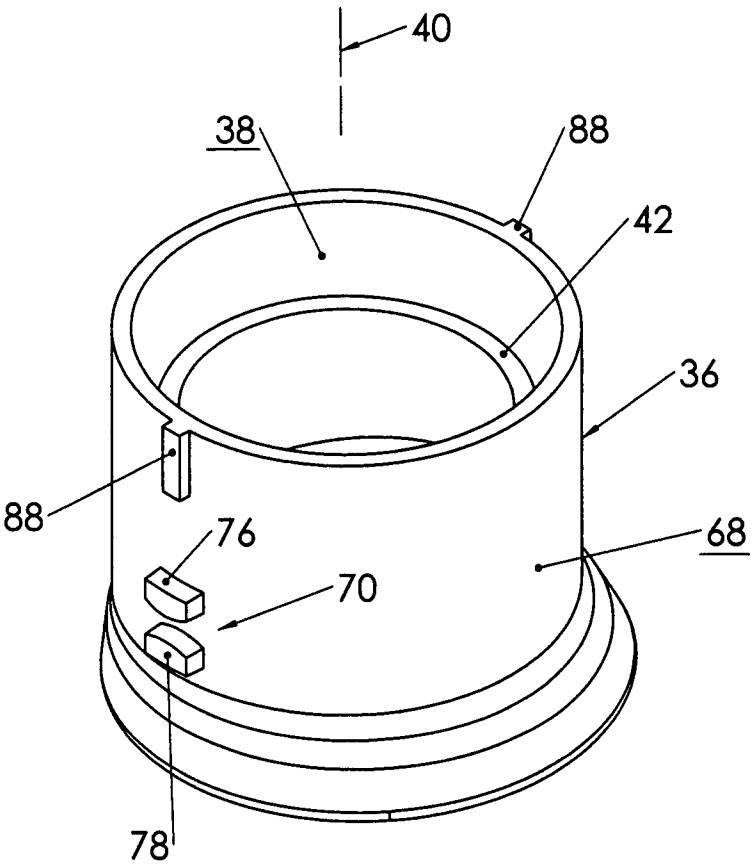
FIG. 16 is a perspective view of a thrust cylinder illustrating the sleeve seat disposed around the radially inner surface, and opposing track followers disposed on the radially outer surface, with a bell flare formed on the bottom, and opposing key lugs formed on the upper radially outer surface.

FIGS. 1 through 18 show an embodiment of hose valve 20 for central vacuum cleaning systems (not illustrated) that employ a retractable suction hose 22 (FIG. 7-8) of the type that retracts into a system vacuum pipe 24. The hose valve 20 comprises a valve box 28 formed to define an interior volume 30, and a connection port 32 that is in communication with the interior volume 30. A locking assembly 34 is secured to the valve box 28. The locking assembly 34 defines a passage for receiving and guiding a retractable hose 22 that extends through the interior volume 30, and through the locking assembly 34 and connection port 32.

More specifically, the locking assembly 34 comprises a compression cylinder 36 having a radially inner cylinder surface 38 disposed about a longitudinal axis 40. Additionally, the compression cylinder 36 includes a sleeve seat 42 disposed around the radially inner cylinder surface 38. The locking assembly 34 also comprises a cylindrical deformable sleeve 44 coaxially disposed within the compression cylinder 36. The deformable sleeve 44 has a compression end 46 arranged to engage the sleeve seat 42, and a flange end 48 formed to be secured to the connection port 32 of the valve box 28. The deformable sleeve 44 is radially inwardly deformable responsive to an axial compressive force, e.g., the deformable sleeve 44 is collapsible inwardly.

In addition, thrust means 50 is provided for engagement with the compression cylinder 36 to impose a compressing force on the deformable sleeve 44. The thrust means 50 is axially movable from a first unlocked non-compressing position where the deformable sleeve 44 is in its non-deformed condition, to a second locked compressed position where the deformable sleeve 44 is compressed to cause deformation with its walls collapsing radially inward to form a seal around a retractable hose 22 disposed through the locking assembly 34.

In addition to forming a seal, the deformable sleeve 44 applies pressure to the retractable hose 22 to firmly hold it in place so that the vacuum created within the hose does not cause the same to retract back into the system vacuum pipe.

As will be discussed more fully below, one embodiment of a thrust means 50 includes a cylindrical thrust ring 54 rotatable about a longitudinal axis 40, and a compression cylinder 36 coaxially disposed within the thrust ring 54.

With this arrangement, the thrust ring 54 defines a radially inner ring surface 56, and two opposing end surfaces 58 and 60. The thrust ring 54 is secured against longitudinal movement within the valve box 28 to restrict movement along the longitudinal axis 40. Further, a helical track 62 is disposed on the radially inner ring surface 56, wherein the helical track 62 is spiraling longitudinally. As noted above, compression cylinder 36 is coaxially disposed within the thrust ring 54, the compression cylinder 36 having a radially inner cylinder surface 38, a sleeve seat 42 disposed around the radially inner cylinder surface 38, and a radially outer cylinder surface 68.

Figure 15:
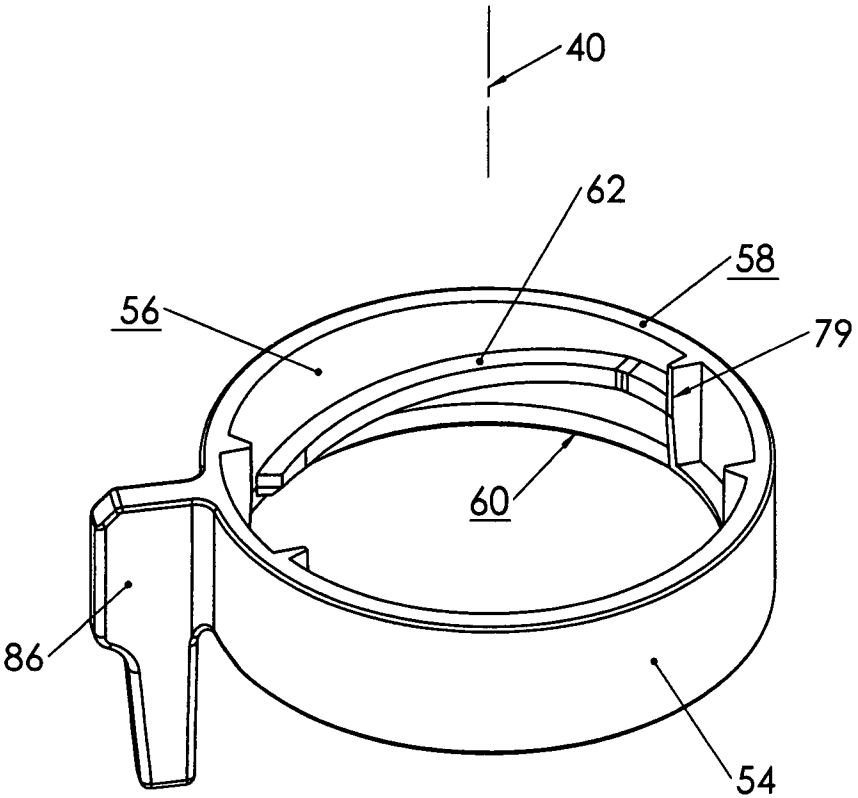
FIG. 15 is a perspective view of a thrust ring illustrating the helical track disposed on the radially inner surface thereof, with the helical track spiraling longitudinally.

Formed on the radially outer cylinder surface 68 of the compression cylinder 36 is a track follower 70 (FIG. 16) disposed for engagement with the helical track 62 (FIG. 15). Disposed within the compression cylinder 36 is a cylindrical deformable sleeve 44. As noted above, the deformable sleeve 44 includes a compression end 46 arranged to engage the sleeve seat 42, and a flange end 48 which defines a flange 72 secured to the connection port 32 of the valve box 28.

With this arrangement, the thrust ring 54 is rotatable about a longitudinal axis 40, wherein the track follower 70 engages the helical track 62 to move the compression cylinder 36 in the direction of the longitudinal axis 40 to compress the deformable sleeve 44. Accordingly, the thrust ring 54 shifts from a first unlocked, non-compressing position (FIG. 9) where the deformable sleeve 44 is in the non-deformed condition, to a second locked, compressing position (FIG. 10) where the compression cylinder 36 shifts coaxially to compress the deformable sleeve, collapsing the sleeve inward to conform around the vacuum hose creating an air tight seal around the vacuum hose 22.

Considering now in more detail the components from which a hose valve 20 is constructed, the track follower 70 comprises an upper track guide 76 spaced apart from a lower track guide 78. This arrangement is provided so that the helical track 62 can move smoothly between the same as the thrust ring 54 is shifted, i.e., rotated, between the first and second position. Accordingly, because the helical track 62 spirals on the inner ring surface 58, the compression cylinder 36 moves up or down along axis 40, depending on which direction the thrust ring 54 is rotated. Another feature of the thrust ring 54, is a track stop 79 (FIG. 15) provided at the end of the helical track 62 to limit the degree of rotation of the thrust ring 54. Further, it should be noted that in the present invention, there are two track followers disposed on opposing sides of the outer surface of the compression cylinder 36 for respective engagement with two helical tracks that are likewise disposed on opposite sides of the inner surface of the thrust ring 54.

Importantly, the thrust ring 54 is held in place in the valve box 28 by slot 80 (FIG. 4) formed by a lower seat 82, molded into the valve box 28, and by the upper box surface 84. As a result, the thrust ring 54 is sandwiched between the lower seat 82 and the upper box surface 84 to prevent movement along axis 40 while it is rotated to move the compression cylinder 36. For ease of movement, the thrust ring 54 is constructed with a locking arm 86 to move the thrust ring 54 back and forth between the first and second position.

Figure 1:
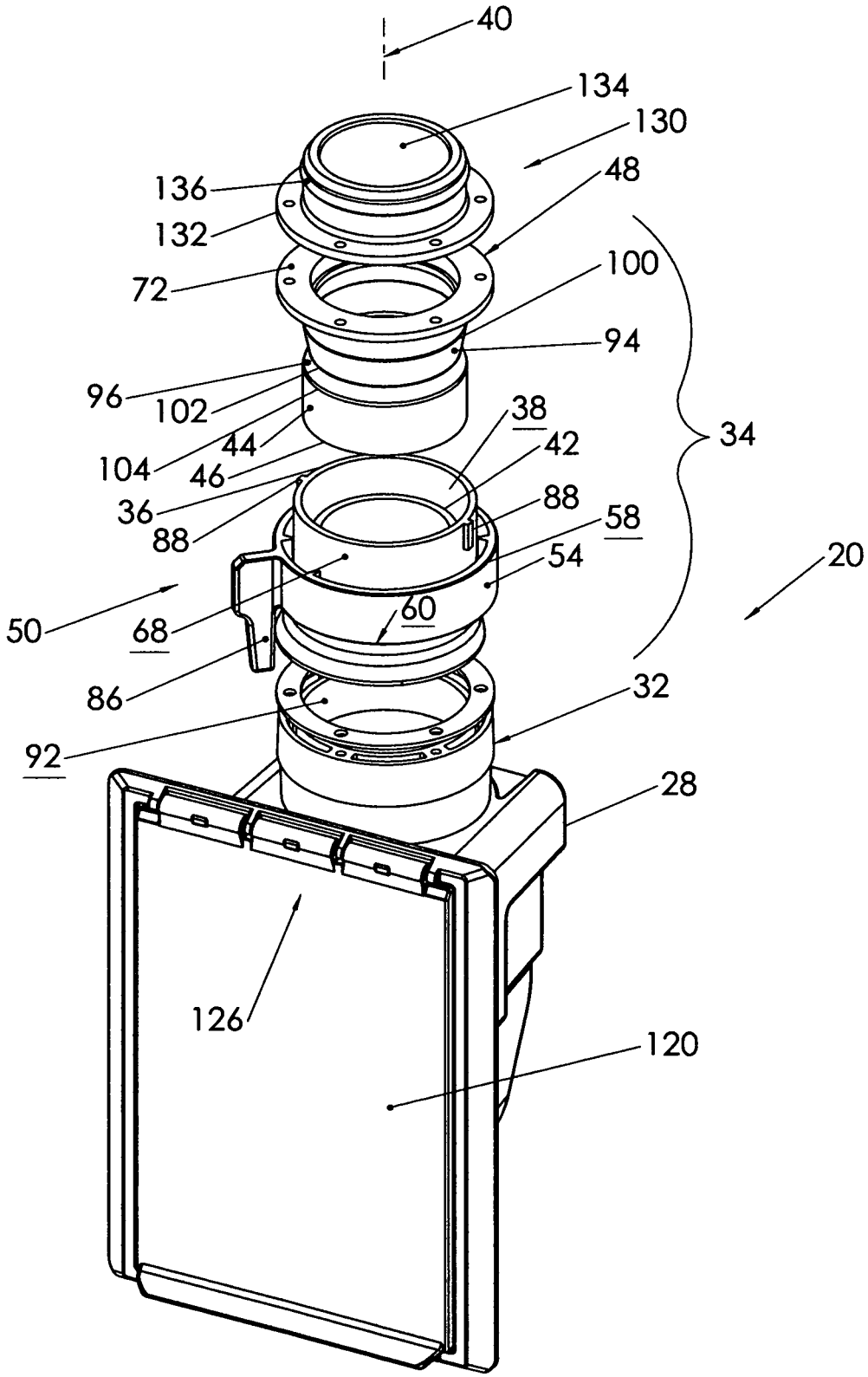
FIG. 1 is an exploded perspective view of a valve box and locking assembly with the thrust ring and thrust cylinder shown out of its normal position within the valve box, to illustrate its relationship to the deformable sleeve.
Figure 2:
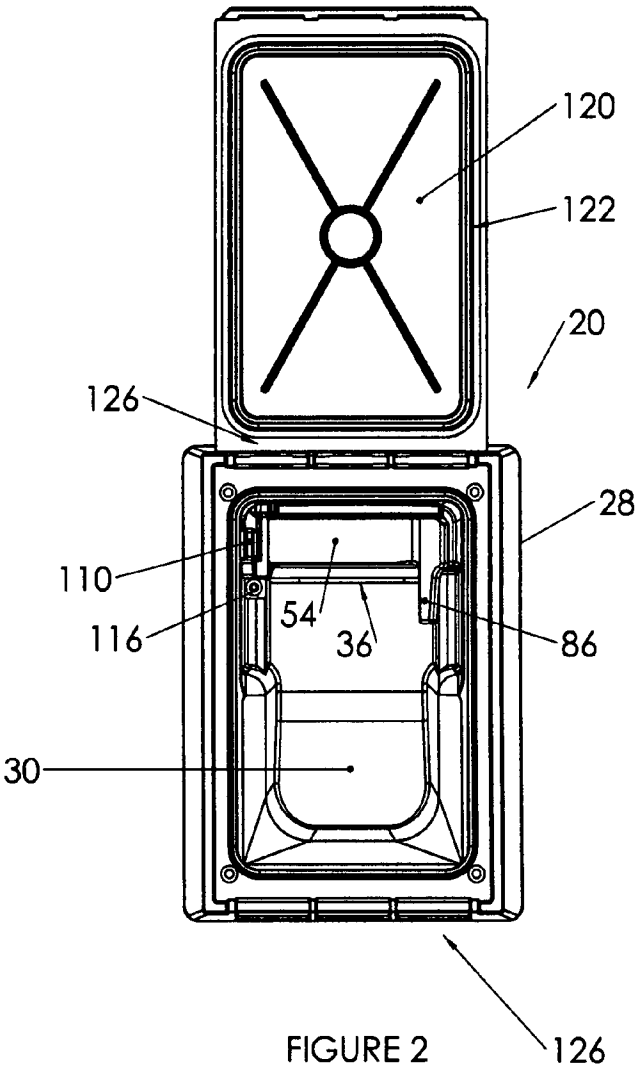
FIG. 2 is a front elevation view of a valve box with a door that opens upward, and the thrust ring in the second locked compressing position.
Figure 3:
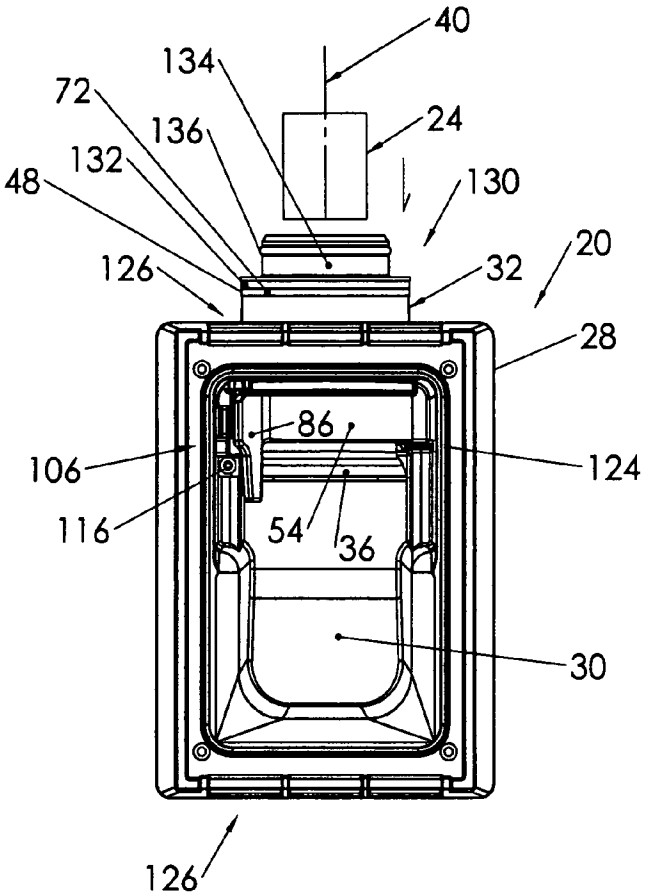
FIG. 3 is a front elevation view of a valve box illustrating its connection port extending upward to receive a vacuum pipe connector, and the thrust ring in the first unlocked, non-compressing position.
Figure 4:
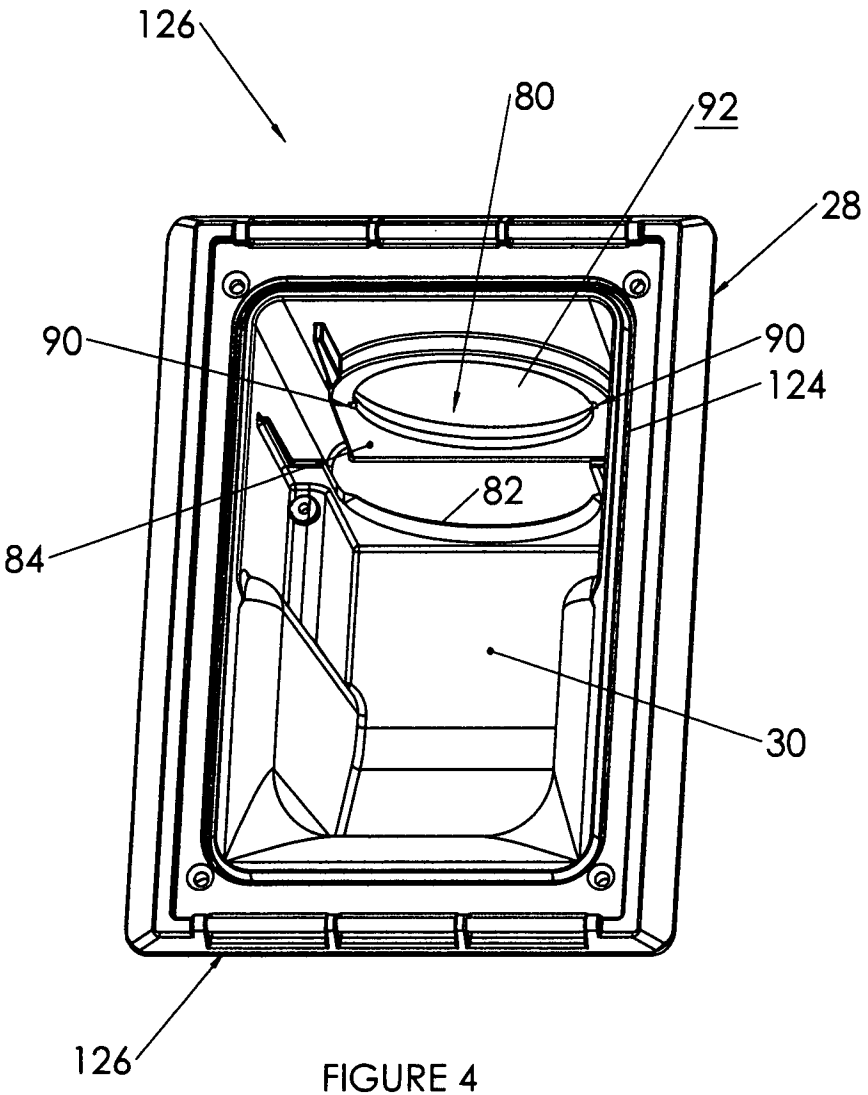
FIG. 4 an upward looking view of the front of a valve box, without a locking assembly, illustrating the thrust ring slot/seat.
Figure 6:
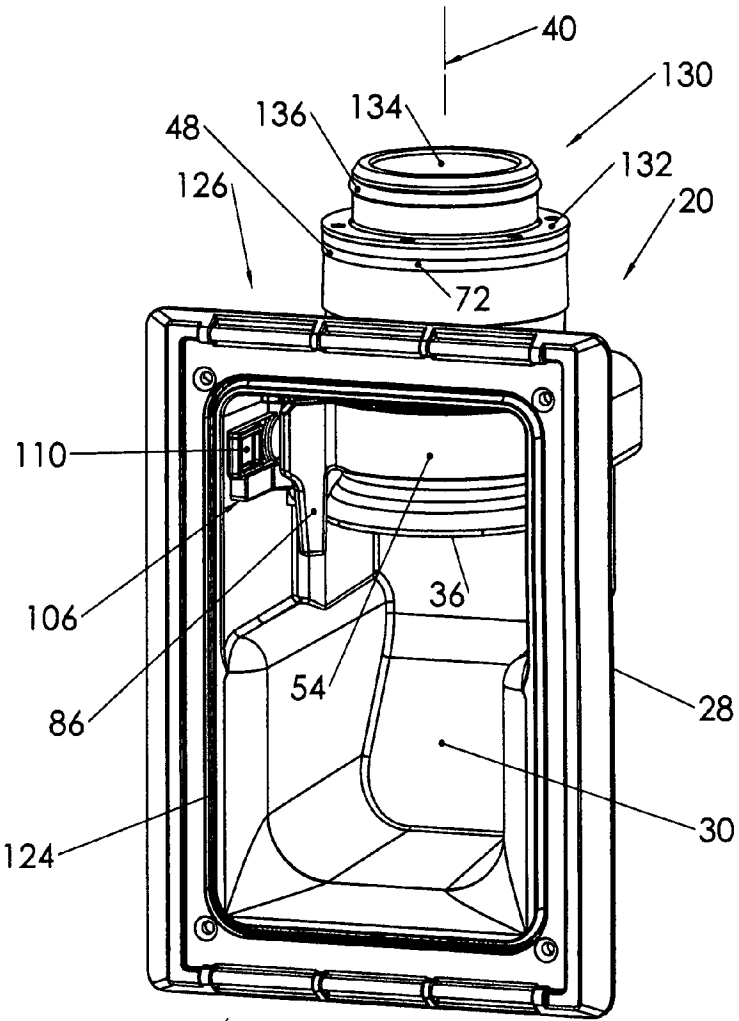
FIG. 6 is a front view of a valve box having a locking assembly and a thrust ring in the first unlocked non-compressing position.
Figure 5:
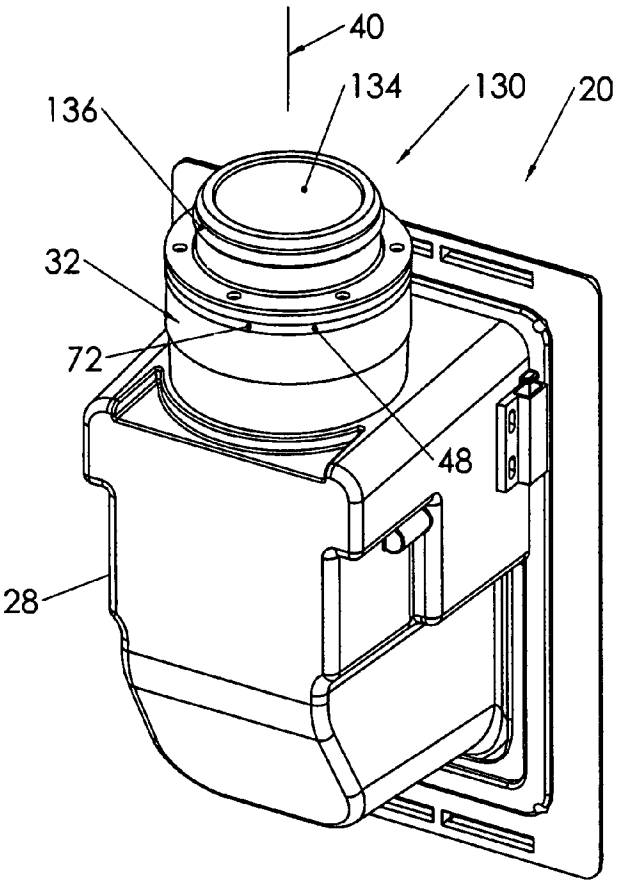
FIG. 5 is a rear perspective view of a valve box.

Directing attention to FIGS. 1 and 4, it should be noted that the compression cylinder 36 includes opposing limit keys 88 formed on the upper portion of the outer cylinder surface 68. The limit keys 88 are sized to slide into opposing keyways 90 formed on the inner port surface 92. In this way, the compression cylinder is prevented from relative rotation.

Turning now to FIGS. 7 through 14, a deformable sleeve 44 is illustrated in its various stages of compression to cause deformation with its walls collapsing radially inward to form a seal around a retractable hose 22 disposed through the locking assembly 34. For this purpose, the deformable sleeve 44 is molded to define two opposing, radially disposed tapered bands, upper tapered band 94 and lower tapered band 96. Because they are adjacent to each other, and because they each taper inward to form a common inner ridge 98, a joint is formed about which their walls collapse when compressive forces are applied as the thrust ring 54 is moved from the first position to the second position. Further, a series of grooves are provided, upper groove 100, ridge groove 103 and lower groove 104, to facilitate the smooth collapsing of the tapered bands 94 and 96.

Considering now, other features of a hose valve 20, the valve box 28 is constructed to receive an electrical switch assembly 106 which comprises a slide bar 110 that slides from a closed position (FIG. 9) to an open position (FIG. 10) within a frame 112. The slide bar 110 includes a magnet 114 that trips a magnetic switch (not illustrated) when the slide bar 110 in the open position. In addition, the switch assembly 100, and frame 112 thereof is fastened to the valve box 20 by fastener 116, and in its fastened condition, the switch assembly 110 assists in maintaining the thrust ring 54 within slot 80.

Turning again to the valve box 28, a door 120 is provided with an o-ring 122 that is arranged to fit within groove 124 formed in the valve box 28 when the door 120 is in the closed condition. As can be seen, door hinge 126 is provided in both the upper portion and lower portion of the valve box 28 so that the direction of swing can be varied depending upon the location of the valve box 28. On the upper portion of the valve box 28 the connection port 32 forms a surface to receive the flange 72 of the deformable sleeve 44. Likewise, a vacuum pipe connector 130 is provided with a connector flange 132 that is sized to mate with flange 72. For connection with a vacuum pipe, the vacuum pipe connector 130 include an extension with an o-ring 136 to form a seal with a vacuum pipe 24. As illustrated, a series of holes through each flange is provided for fasteners (not illustrated) that extend through the connector flange 132 to the connection port 32.

Figure 17:
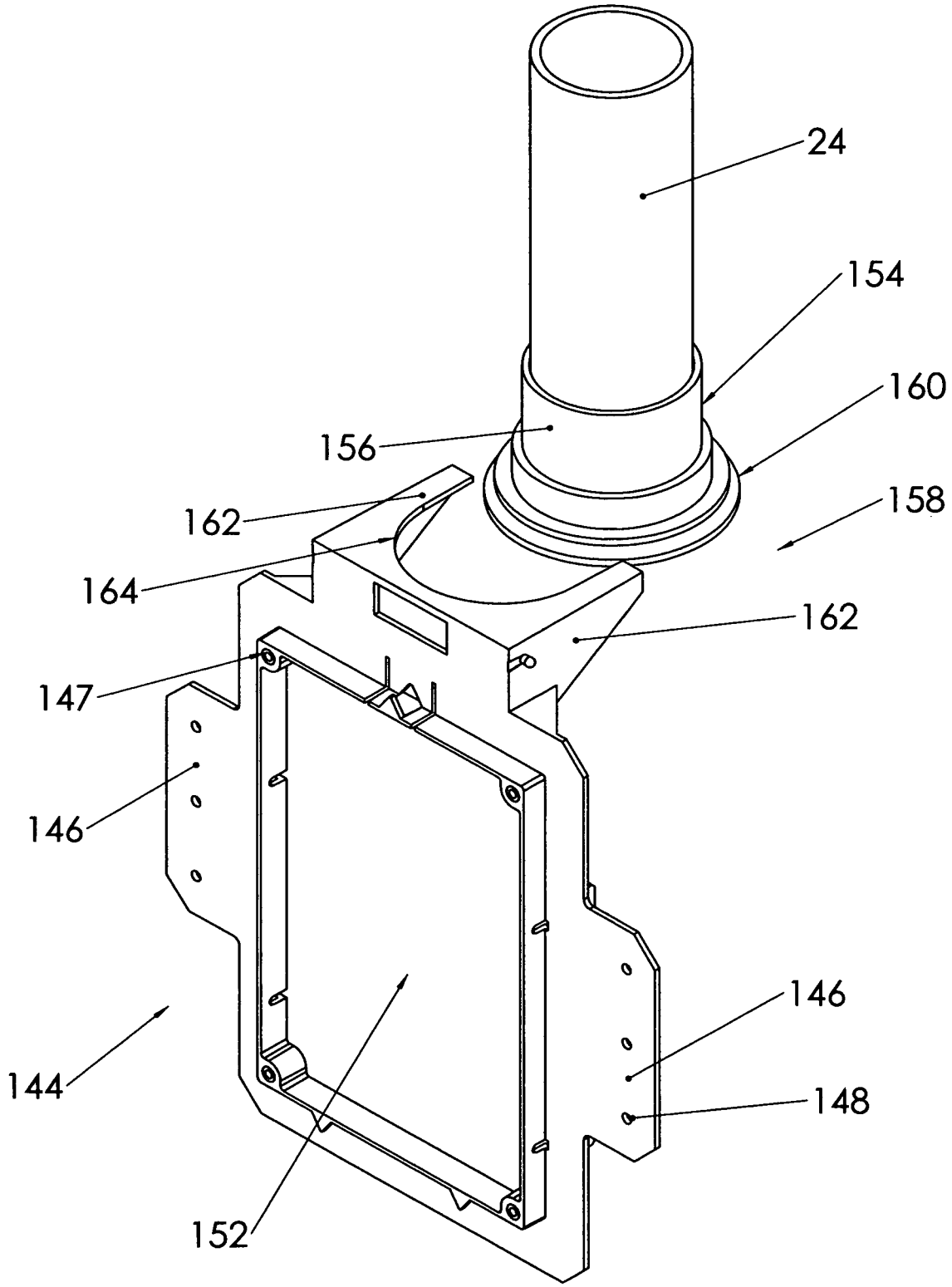
FIG. 17 is a perspective view of a mounting assembly employed to secure a valve box to a wall stud.
Figure 18:
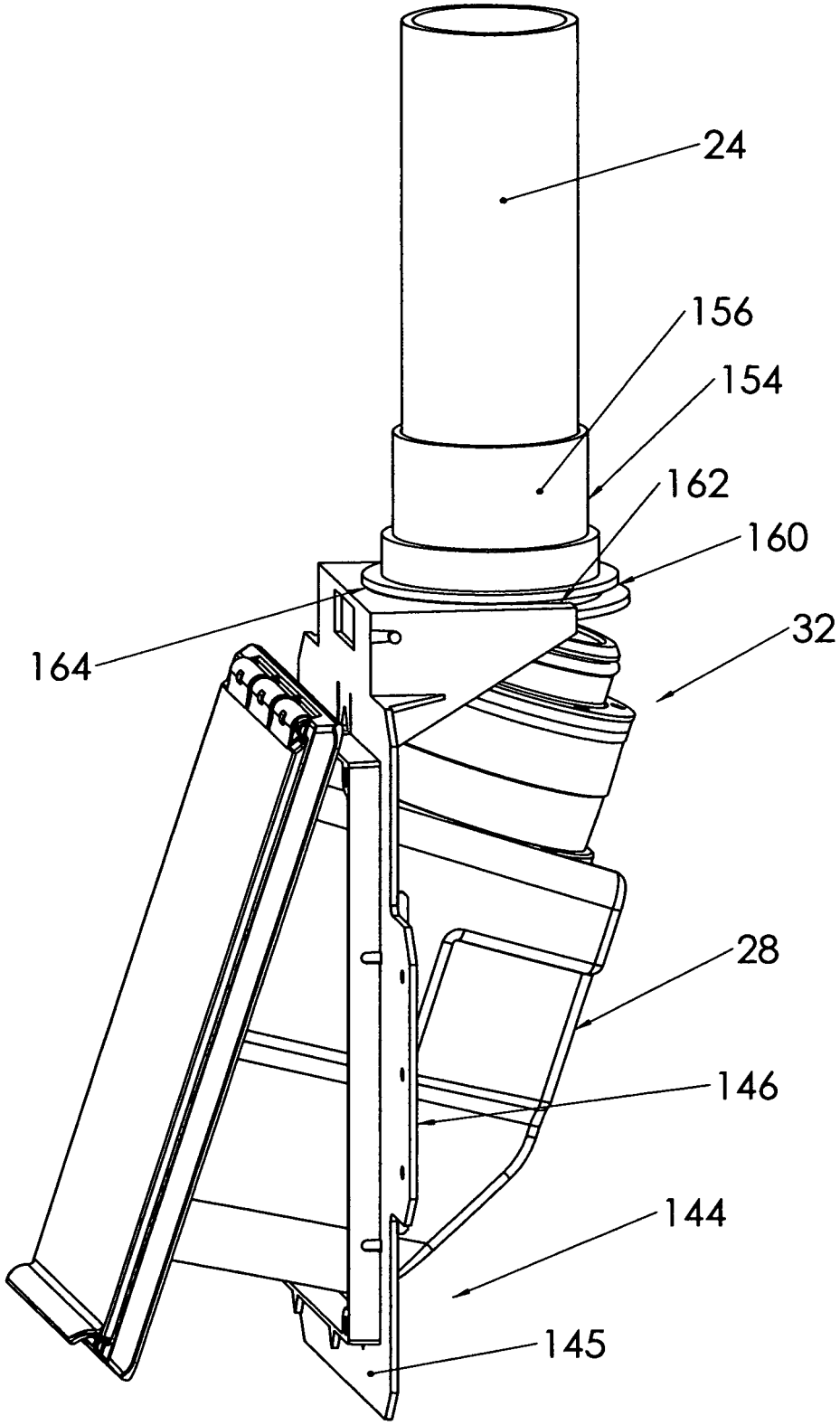
FIG. 18 is a side view of a valve box being received into and through the opening formed by a mounting plate, wherein the vacuum pipe connector of the valve box is aligned with the receiving tube having a system vacuum pipe connected thereto.

Directing attention now to FIGS. 17 and 18, a mounting assembly 144 is illustrated. The mounting assembly 144 is provided to secure the valve box 28 to a surface (not illustrated) such as a wall stud commonly found in wall construction. For this purpose, the mounting assembly 144 includes a mounting plate 145 having opposing mounting flanges 146. Each mounting flange 146 includes a plurality of mounting holes 148 for nailing or screwing the mounting assembly 144 to a wall stud. In addition, the mounting assembly plate 145 defines an opening 152 sized to receive a valve box 28 through the same. To secure the valve box 28 to the mounting plate 145, a plurality of threaded bores 147 are incorporated in the mounting plate 145.

Finally, to provide a sealed connection between the connection port 32 of valve box 28, and the system pipe 24, a movable receiving tube 154 is employed. The receiving tube 154 comprises a receiving neck 156 arranged to receive a system vacuum pipe 24, and a sealing end 158 arranged to sealingly connect to the connection port 32. For this purpose, the receiving tube 154 includes a slot 160 formed in the sealing end 158 of the receiving tube 154. The slot 160 is adapted to be received between two opposing elongate receiving arms 162 formed in the mounting plate 145. The receiving arms 162 define an edge 164 that fits into slot 160. Accordingly, the slot 160 accommodates lateral movement between the mounting plate 145 and the receiving tube 154. This, in turn, allows for movement to adjust the position of the valve box in relation to the mounting plate 145.

In the drawings and specifications there have been set forth preferred embodiments of the invention and although specific terms are employed, they are used in a generic and descriptive sense only and not for purposes of limitation. The design of the hose valve depicted in this invention combine several functions, that of sealing, restraining and wear reduction, into one device or mechanism. Separate devices or mechanisms could be used for each function. Other devices or mechanisms could be used to achieve the functions and results.

In addition, whereas the drawings and specifications relate to central vacuum cleaning systems for a home or building, the application is not limited to this industry alone but to any industry or operation where a vacuum system is used.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

What is claimed is:

1. A hose valve for central vacuum cleaning systems having retractable suction hoses that retract into a system vacuum pipe, the hose valve comprising:

a valve box formed to define an interior volume, and a connection port arranged and disposed for communication with the interior volume;

a locking assembly secured to the valve box, the locking assembly defining a passage for receiving and guiding a retractable hose that extends through the interior volume, and through the locking assembly, the locking assembly comprising:

a compression cylinder having a radially inner cylinder surface disposed about a longitudinal axis, and a sleeve seat formed around the radially inner cylinder surface, the compression cylinder also having a radially outer cylinder surface;

a cylindrical deformable sleeve coaxially disposed within the compression cylinder, the deformable sleeve having a compression end arranged to engage the sleeve seat, and a flange end formed to be secured to the connection port of the valve box, the deformable sleeve being radially inwardly deformable responsive to an axial compressive force directed parallel to the longitudinal axis of the compression cylinder; and thrust means engageable with the compression cylinder to impose a compressive force on the deformable sleeve, the thrust means being axially movable from a first unlocked non-compressing position where the deformable sleeve is in its non-deformed condition, to a second locked compressing position where the deformable sleeve is axially compressed to cause deformation with its walls collapsing radially inward to form a seal around a retractable hose disposed through the locking assembly.

2. A hose valve as recited in claim 1 wherein the deformable sleeve comprises an upper tapered band and an adjacent lower tapered band, wherein the upper tapered band and the lower tapered band join to form an inner ridge to bias the deformable sleeve to collapse inward responsive to a compressive force applied to the deformable sleeve.

3. A hose valve as recited in claim 1 further comprising a mounting assembly arranged for attachment to a surface, the mounting assembly comprising a mounting plate arranged to receive the valve box, wherein the valve box is securable to the mounting plate to fix the valve box in relation to a surface.

4. A hose valve as recited in claim 3 wherein the mounting assembly further comprises a movable receiving tube that defines a receiving neck for receiving a system vacuum pipe, and a sealing end for receiving the connection port of the valve box, to seal the connection port to the system vacuum pipe, wherein the receiving tube is movable to provide adjustment of the position of the valve box in relation to the mounting plate.

5. A hose valve as recited in claim 1 further comprising a switch assembly to control an electrical circuit provided to energize a device employed in the central vacuum system, the switch assembly being movable from a first off position where the an electrical circuit is interrupted, to a second on position that completes the electrical circuit.

6. A hose valve as recited in claim 5 wherein the switch assembly is removably mounted within the valve box, wherein removal of the switch assembly enab les removal of the thrust means from the valve box.

7. A hose valve for central vacuum cleaning systems having retractable suction hoses that retract into a system vacuum pipe, the hose valve comprising:

a valve box formed to define an interior volume, and a connection port arranged and disposed for communication with the interior volume;

a locking assembly secured to the valve box, the locking assembly defining a passage for receiving and guiding a retractable hose that extends through the interior volume, and through the locking assembly, the locking assembly comprising:

a compression cylinder having a radially inner cylinder surface disposed about a longitudinal axis, and a sleeve seat formed around the radially inner cylinder surface, the compression cylinder also having a radially outer cylinder surface;

a cylindrical deformable sleeve coaxially disposed within the compression cylinder, the deformable sleeve having a compression end arranged to engage the sleeve seat, and a flange end formed to be secured to the connection port of the valve box, the deformable sleeve being radially inwardly deformable responsive to an axial compressive force;

thrust means engageable with the compression cylinder to impose a compressive force on the deformable sleeve, the thrust means being axially movable from a first unlocked non-compressing position where the deformable sleeve is in its non-deformed condition, to a second locked compressing position where the deformable sleeve is axially compressed to cause deformation with its walls collapsing radially inward to form a seal around a retractable hose disposed through the locking assembly, said thrust means comprising:

a cylindrical thrust ring rotatable about the longitudinal axis, the thrust ring defining a radially inner ring surface, and two opposing end surfaces, the thrust ring being secured within the valve box to restrict longitudinal movement, of the thrust ring, along the axis;

a helical track disposed on the radially inner ring surface, the helical track spiraling longitudinally, about the longitudinal axis, wherein a track follower is disposed on the radially outer cylinder surface of the compression cylinder for engagement with the helical track; and wherein the compression cylinder is disposed within the thrust ring, engaging the track follower with the helical track, and wherein the thrust ring is rotatable about the longitudinal axis from a first unlocked, non-compressing position where the deformable sleeve is in the non-deformed condition, to a second locked, compressing position where the compression cylinder shifts coaxially to compress the deformable sleeve, collapsing the sleeve inward to conform around the vacuum hose creating an air tight seal around the vacuum hose.

8. A hose valve as recited in claim 7 further comprising a mounting assembly arranged for attachment to a surface, the mounting assembly comprising a mounting plate arranged to receive the valve box, wherein the valve box is securable to the mounting plate to fix the valve box in relation to a surface.

9. A hose valve as recited in claim 8 wherein the mounting assembly further comprises a movable receiving tube that defines a receiving neck for receiving a system vacuum pipe, and an opposing sealing end for receiving the connection port of the valve box, to seal the connection port to the system vacuum pipe, wherein the receiving tube is movable to provide adjustment of the position of the valve box in relation to the mounting plate.

10. A method for making a hose valve for central vacuum cleaning systems having retractable suction hoses that retract into a system vacuum pipe, the method comprising the steps:

forming a valve box to define an interior volume, and a connection port arranged and disposed for communication with the interior volume;

securing a locking assembly to the valve box, the locking assembly defining a passage for receiving and guiding a retractable hose that extends through the interior volume, and through the locking assembly, the locking assembly comprising:

a compression cylinder having a radially inner cylinder surface disposed about a longitudinal axis, and a sleeve seat formed around the radially inner cylinder surface, the compression cylinder also having a radially outer cylinder surface;

a cylindrical deformable sleeve coaxially disposed within the compression cylinder, the deformable sleeve having a compression end arranged to engage the sleeve seat, and a flange end formed to be secured to the connection port of the valve box, the deformable sleeve being radially inwardly deformable responsive to an axial compressive force directed parallel to the longitudinal axis of the compression cylinder; and thrust means engageable with the compression cylinder to impose a compressive force on the deformable sleeve, the thrust means being axially movable from a first unlocked non-compressing position where the deformable sleeve is in its non-deformed condition, to a second locked compressing position where the deformable sleeve is axially compressed to cause deformation with its walls collapsing radially inward to form a seal around a retractable hose disposed through the locking assembly.

11. A method for making a hose valve as recited in claim 10 further comprising the steps of forming a mounting assembly arranged for attachment to a surface, the mounting assembly comprising a mounting plate arranged to receive the valve box, wherein the valve box is securable to the mounting plate to fix the valve box in relation to a surface.

12. A method for making a hose valve as recited in claim 11 wherein the mounting assembly further comprises a movable receiving tube that defines a receiving neck for receiving a system vacuum pipe, and a sealing end for receiving the connection port of the valve box, to seal the connection port to the system vacuum pipe, wherein the receiving tube is movable to provide adjustment of the position of the valve box in relation to the mounting plate.

13. A method for making hose valve as recited in claim 10 wherein the deformable sleeve comprises an upper tapered band and an adjacent lower tapered band, wherein the upper tapered band and the lower tapered band join to form an inner ridge to bias the deformable sleeve to collapse inward responsive to a compressive force applied to the deformable sleeve.

14. A method for making a hose valve as recited in claim 10 further comprising the step of incoprorating a switch assembly to control an electrical circuit provided to energize a device employed in the central vacuum system, the switch assembly being movable from a first off position where the an electrical circuit is interrupted, to a second on position that completes the electrical circuit, and the switch assembly being removably mounted within the valve box, wherein removal of the switch assembly enables removal of the thrust means from the valve box.

15. A method for making a hose valve for central vacuum cleaning systems having retractable suction hoses that retract into a system vacuum pipe, the method comprising the steps:

forming a valve box to define an interior volume, and a connection port arranged and disposed for communication with the interior volume;

securing a locking assembly to the valve box, the locking assembly defining a passage for receiving and guiding a retractable hose that extends through the interior volume, and through the locking assembly, the locking assembly comprising:

a compression cylinder having a radially inner cylinder surface disposed about a longitudinal axis, and a sleeve seat formed around the radially inner cylinder surface, the compression cylinder also having a radially outer cylinder surface;

a cylindrical deformable sleeve coaxially disposed within the compression cylinder, the deformable sleeve having a compression end arranged to engage the sleeve seat, and a flange end formed to be secured to the connection port of the valve box, the deformable sleeve being radially inwardly deformable responsive to an axial compressive force;

thrust means engageable with the compression cylinder to impose a compressive force on the deformable sleeve, the thrust means being axially movable from a first unlocked non-compressing position where the deformable sleeve is in its non-deformed condition, to a second locked compressing position where the deformable sleeve is axially compressed to cause deformation with its walls collapsing radially inward to form a seal around a retractable hose disposed through the locking assembly, wherein engaging said thrust means comprises the steps:

providing a cylindrical thrust ring rotatable about the longitudinal axis, the thrust ring defining a radially inner ring surface, and two opposing end surfaces, the thrust ring being secured within the valve box to restrict longitudinal movement, of the thrust ring, along the axis;

forming a helical track disposed on the radially inner ring surface, the helical track spiraling longitudinally, about the longitudinal axis, wherein a track follower is formed on the radially outer cylinder surface of the compression cylinder for engagement with the helical track; and wherein the compression cylinder is disposed within the thrust ring, engaging the track follower with the helical track, and wherein the thrust ring is rotatable about the longitudinal axis from a first unlocked, non-compressing position where the deformable sleeve is in the non-deformed condition, to a second locked, compressing position where the compression cylinder shifts coaxially to compress the deformable sleeve, collapsing the sleeve inward to conform around the vacuum hose creating an air tight seal around the vacuum hose.

16. A hose valve for central vacuum cleaning systems having retractable suction hoses that retract into a system vacuum pipe, the hose valve comprising:

a valve box formed to defining an interior volume, and a connection port in communication with the interior volume;

a locking assembly secured to the valve box for receiving and guiding a retractable hose that extends through the interior volume, the locking assembly comprising:

a cylindrical thrust ring rotatable about a longitudinal axis, the thrust ring defining a radially inner ring surface, and two opposing end surfaces, the thrust ring being secured within the valve box to restrict longitudinal movement along the axis;

a helical track disposed on the radially inner ring surface, the helical track spiraling longitudinally;

a compression cylinder disposed within the thrust ring, the compression cylinder having a radially inner cylinder surface, a sleeve seat disposed around the radially inner cylinder surface, and a radially outer cylinder surface;

a track follower disposed on the radially outer cylinder surface for engagement with the helical track;

a cylindrical deformable sleeve disposed within the compression cylinder, the deformable sleeve having a compression end arranged to engage the sleeve seat, and a flange end secured to the connection port of the valve box; and the thrust ring being rotatable about a longitudinal axis from a first unlocked, non-compressing position where the deformable sleeve is in the non-deformed condition, to a second locked, compressing position where the compression cylinder shifts coaxially to compress the deformable sleeve, collapsing the sleeve inward to conform around the vacuum hose creating an air tight seal around the vacuum hose.

17. A hose valve as recited in claim 16 wherein the deformable sleeve comprises an upper tapered band and an adjacent lower tapered band, wherein the upper tapered band and the lower tapered band join to form an inner ridge to bias the deformable sleeve to collapse inward responsive to a compressive force applied to the deformable sleeve.

18. A hose valve as recited in claim 17 further comprising a mounting assembly arranged for attachment to a surface, the mounting assembly comprising a mounting plate arranged to receive the valve box, wherein the valve box is securable to the mounting plate to fix the valve box in relation to a surface.

19. A hose valve as recited in claim 18 wherein the mounting assembly further comprises a movable receiving tube that defines a receiving neck for receiving a system vacuum pipe, and an opposing sealing end for receiving the connection port of the valve box, to seal the connection port to the system vacuum pipe, wherein the receiving tube is movable to provide adjustment of the position of the valve box in relation to the mounting plate.

20. A hose valve as recited in claim 19 further comprising a switch assembly to control an electrical circuit provided to energize a device employed in the central vacuum system, the switch assembly being movable from a first off position where the an electrical circuit is interrupted, to a second on position that completes the electrical circuit, and the switch assembly being removably mounted within the valve box, wherein removal of the switch assembly enables removal of the thrust means from the valve box.

* * * * *